United States Patent [19]

Roberts

[11] 4,051,954

[45] Oct. 4, 1977

[54] COUPLER BUTT END REPLACEMENT METHOD AND PART

[75] Inventor: Leslie N. Roberts, Columbus, Ohio

[73] Assignee: Buckeye International, Inc., Columbus, Ohio

[21] Appl. No.: 694,781

[22] Filed: June 10, 1976

[51] Int. Cl.[2] ..... B61G 9/00

[52] U.S. Cl. ..... 213/62 R; 29/401 R

[58] Field of Search ..... 280/415 R, 415 A, 415 B, 280/477, 423 R; 29/401 R; 213/62 R, 62 A, 63, 57; 105/420

[56] References Cited

U.S. PATENT DOCUMENTS

| | | | |
|---|---|---|---|
| 2,195,256 | 3/1940 | Palmer | 29/401 |
| 2,873,981 | 2/1959 | Grant | 280/477 |
| 3,561,370 | 2/1971 | Reynolds | 213/57 |
| 3,860,121 | 1/1975 | Snell | 213/62 R |
| 3,876,232 | 4/1975 | Pertusi | 280/415 A |
| 3,973,681 | 8/1976 | Martin | 213/57 |

*Primary Examiner*—Trygve M. Blix
*Assistant Examiner*—D. W. Keen
*Attorney, Agent, or Firm*—Charles F. Pigott, Jr.

[57] ABSTRACT

The following specification describes a replacement method and part for a coupler butt end in which the coupler is severed at the narrow hollow perimeter wall of the coupler shank close to the solid worn butt end portion. A cast replacement butt end part having a chamfer at the front end and a ring lip spaced inwardly of the front end is fitted to the coupler shank and welded thereto. The lip serves as a back up for the weld between the end surfaces of the coupler shank and the front end of the replacement part.

14 Claims, 5 Drawing Figures

10
12
14
16
18
20
21
21a
22
24
26
28
30
32
45°

COUPLER BUTT END REPLACEMENT METHOD AND PART

BACKGROUND OF THE INVENTION

This invention relates in general to a method of replacing a worn butt end portion of a railroad car coupler and more particularly to a butt end replacement part for the worn butt end portion of a railroad car coupler.

The butt end portion of railroad car couplers are subject to severe stress and wear resulting from engagement with the center sill cushioning assembly and the action of the draft key, which passes through a draft key slot in the coupler butt end portion. Therefore at such time as the railroad car on which the couplers are mounted have been in prolonged service or have accumulated considerable mileage, replacement or repair of the couplers is required to meet AAR and/or FRA requirements. Since the coupler head and shanks are in relatively good condition at such time, it is of considerable economic benefit to simply replace the worn butt end portion of the coupler while retaining the coupler head and shanks.

In the present invention it is therefore proposed to sever the coupler at a selected position along the hollow shank of the coupler. The hollow shank is defined by a ring or perimeter wall to which is attached a new or butt end replacement part having a size and shape corresponding to the original size and shape of the severed but end portion. The replacement part is formed by casting and it has a peripheral chamfer at it's front end extending inwardly and forwardly to a front peripheral lip having an outer perimeter corresponding to the inner periphery of the shank wall so that the lip is received in the hollow shank. The butt end part is then aligned angularly and longitudinally adjusted to provide an overall coupler length corresponding to the original coupler length and the end perimeter of the butt end part welded to the end perimeter of the coupler shank wall at the chamfer with the lip serving as a back up for the weld metal. The weld is then conventionally heat treated.

It is therefore among the objects of the present invention to provide an improved method and/or part for replacing the worn butt end portion of a railroad car coupler.

Other objects and features of the present invention will become apparent on examination of the following specification and claims together with the accompanying drawings.

DESCRIPTION OF THE PREFERRED EMBODIMENT

Figures 1, 2, 3, 4, 5:
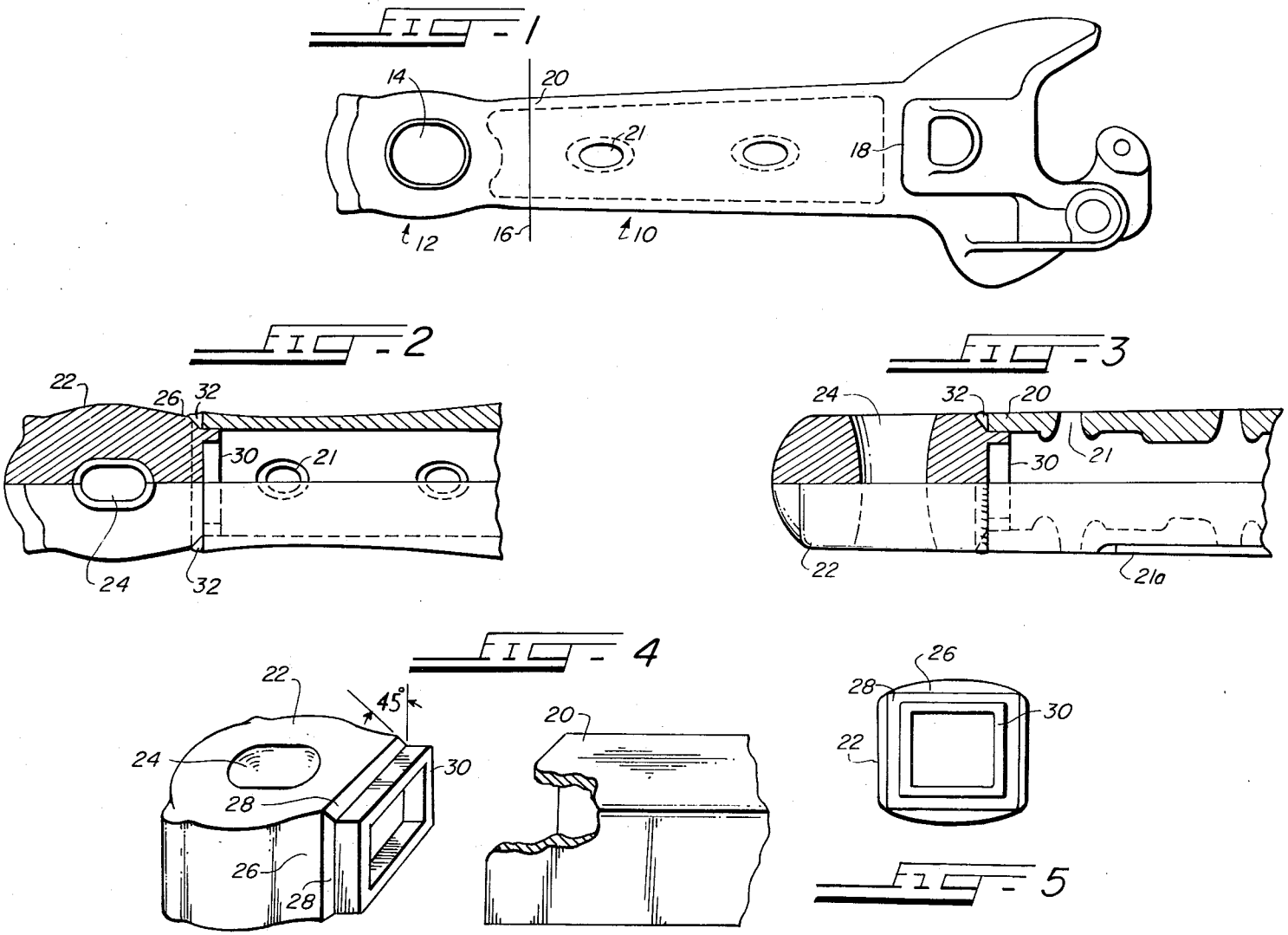
FIG. 1 is a top elevational view of a coupler having a worn butt end portion.
FIG. 2 is a top elevational view in partial section of the shank portion of the coupler seen in FIG. 1 together with a half sectional top elevational view of the butt end replacement part employing the principles of the present invention.
FIG. 3 is a side elevational view in partial section of the shank portion of the coupler seen in FIG. 1 together with a half sectional side elevational view of the butt end replacement part employing the principles of the present invention.
FIG. 4 is an exploded isometric view of the butt end replacement part together with a relevant shank portion partially broken away.
FIG. 5 is a front elevational view of a coupler butt end replacement part employing the principles of the present invention.

In FIG. 1 a coupler of conventional design is indicated by the reference character 10. The coupler 10 has a butt or rear end portion 12 with an arcuate rear surface which engages a follower or conventional cushioning assembly with considerable impact in response to coupling and other forces. The portion 12 is solid, but has a passageway or slot 14 which receives a yoke swivel or draft key for securing a yoke to coupler. The butt end 12 is therefore subject to considerable wear both where it engages the cushioning assembly and at the passageway 14, since the swivel key is subject to movement relative the slot under considerable force.

To avoid discarding the entire coupler, the coupler 10 is cut along the line 16 perpendicular to the longitudinal axis of the coupler, as shown in FIG. 1 and at approximately 26½ inches from the coupler horn indicated at 18. This cut is thus taken at a narrow portion of the hollow coupler shank defined by a perimeter or ring wall 20 and intermediate the solid butt end portion 12 and spaced from the shank holes 21 and wear plate 21*a.* At this position the internal surfaces of wall 20 are substantially flat.

The cut end portion 12 is replaced by a new or replacement part 22 seen in FIGS. 2–5. Part 22 is a solid casting having a rounded or arcuate rear end surface and conforms to the original size and shape or contour of portion 12 except as will be hereinafter noted. The part 22 includes a slot or passage 24 for receiving the draft key.

The part 22 is different than portion 12 in that is has a front end 26, which is provided with a peripheral or ring chamfer 28 extending inwardly and forwardly of the outer surface of part 22 and terminating in a lip or projection 30 spaced inwardly from the outer periphery of the replacement butt end part 22 and projecting forwardly of the front end 26. The distance between the arcuate rear end of part 22 and the end of chamfer 28 at lip 30 is substantially 9$\mu$ inches and the chamfer has an angle of substantially 45° to the lip. Lip 30 is received in the rear severed or cut end portion of the coupler shank wall 20. The lip 30 is ring shaped having side dimensions of substantially 5 inches × 49/16 inches and defines a perimeter corresponding to the inner peripheral surface of the coupler shank wall 20 and it terminates short of the first core hole 21 and wear plate 21*a.*

Lip 30 projects substantially ⅝ inch from the front end 26 of the replacement part 22 permitting insertion of the lip for angular and longitudinal alignment of the part 22 with the shank wall 20 of the coupler.

Lip 30 provides longitudinal adjustment of part 22 relative wall 20 to provide a total coupler length of 36¼ inches ± 3/16 inch between the horn 18 and the arcuate rear surface of part 22. A weld 32 is then formed about the perimeter of the chamfer 28 and between the front end 26 of part 22 and the severed rear end surface of the shank perimeter wall 20. The lip 30 extends across any gap between chamfer 28 and the rear face of wall 20 and serves as a back up member for the weld metal since the spacing between the chamfer and the end of wall 20 will depend on the longitudinal adjustment. With a ¼ inch gap, a flux cored wire is used for welding and with a 3/8 inch minimum gap, a stick electrode is used. After welding the weld 32 is given a conventional draw treatment at, for example, 1150° - 1200° for two hours. With the weld completed and heat treated the coupler is now ready for conventional service.

The foregoing constitutes a description of a method and a part for replacing the worn butt end of a railroad car coupler and the inventive concepts are believed set forth in the accompanying claims.

What is claimed is:

1. A replacement part for a coupler having a hollow shank terminating in a butt end portion and severed at a first predetermind position to provide a front coupler portion having a hollow rear end defined by the severed perimeter wall of said shank, the improvement comprising:

a butt end part having a size corresponding to the original size of the severed butt end portion and having a front end with a perimeter sized and shaped to correspond with the rear end of said perimeter wall, a projection on the front end of said part spaced inwardly of the perimeter of said part receipt in said hollow shank, and a chamfer formed at the front end of said butt end part extending from the perimeter of the front end of said part inwardly and forwardly to said projection.

2. The part claimed in claim 1 in which said part is solid and has a draft key passageway with the contour of said butt end part corresponding to the original contour of said worn butt end portion.

3. The part claimed in claim 1 in which said chamfer extends about the periphery of said part adjacent said front end.

4. The part claimed in claim 1 in which said projection is a substantially closed ring and has an outer surface engaging the inner surface of said perimeter wall.

5. The part claimed in claim 1 in which said chamfer has an angle of substantially 45° to said projection.

6. The part claimed in claim 1 in which said projection enables longitudinal adjustment of said part relative said shank to provide a predetermined overall length for said coupler.

7. The part claimed in claim 6 in which said part is welded to said perimeter wall at said chamfer, and said projection bridges any gap between said chamfer and said perimeter wall to provide a back up for said weld.

8. A method of repairing a coupler having a butt end portion worn from the original shape or size and a useable hollow coupler shank portion formed by a perimeter wall; the improvement comprising the steps of;

severing said perimeter wall to separate said worn butt end portion from said coupler shank, and form an end face for said severed perimeter wall, forming a replacement butt end part corresponding to the original shape and size of said worn butt end portion with said new butt end part having a front end with a periphery corresponding to the end face of said perimeter wall and a chamfer extending forwardly and inwardly of the periphery of said front end terminating in a forwardly extending projection corresponding to the internal periphery of said perimeter wall, assembling said replacement butt end part to said shank with said chamfer adjacent the end face of said perimeter wall and said projection engaged within said perimeter wall;

and welding said new part to said shank at said chamfer with said projection serving as a back up for said weld.

9. The method claimed in claim 8 in which said chamfer extends at substantially 45° to said projection.

10. The method claimed in claim 9 in which said replacement part is formed by casting.

11. The method claimed in claim 8 in which said projection extends forwardly of said front end a predetermined distance and the position of said part and lip are longitudinally adjusted relative said perimeter wall to provide a total overall length for said wall and replacement part having a predetermined value.

12. The method claimed in claim 8 in which said projection has an outer ring shape conforming to the inner periphery of said perimeter wall.

13. The method claimed in claim 8 in which said replacement part is welded to said end face at said chamfer and said projection bridges the gap between said chamfer and said perimeter wall.

14. The method claimed in claim 8 in which said projection extends substantially ⅝ inch and the overall length of said coupler and part are substantially 36 inches.

* * * * *